United States Patent [19]

McMakin et al.

[11] Patent Number: 4,770,273

[45] Date of Patent: Sep. 13, 1988

[54] LADDER LIFT APPARATUS

[75] Inventors: William H. McMakin; Mark R. McMakin; Glen R. McMakin, all of Silver Spring, Md.

[73] Assignee: McCrane Co., Washington, D.C.

[21] Appl. No.: 129,069

[22] Filed: Dec. 7, 1987

[51] Int. Cl.[4] ..... E06C 7/12

[52] U.S. Cl. ..... 182/129; 182/102; 187/2; 187/11

[58] Field of Search ..... 182/129, 102, 116, 93; 187/2, 9 R, 10, 11; 254/393

[56] References Cited

U.S. PATENT DOCUMENTS

| | | | |
|---|---|---|---|
| 731,708 | 6/1903 | Quinn | 182/102 |
| 738,164 | 9/1903 | Cody | 182/102 |
| 921,431 | 5/1909 | Miller | 182/145 |
| 1,620,254 | 3/1927 | Gauss | 182/129 |
| 2,118,585 | 5/1938 | Alber | 182/116 |
| 3,074,508 | 1/1963 | Book | 182/129 |
| 3,902,700 | 9/1975 | Cox | 182/102 |
| 3,964,573 | 6/1976 | Wilson | 182/116 |
| 4,128,228 | 12/1978 | Ziegelmann | 187/11 |
| 4,690,248 | 9/1987 | Killen | 182/17 |

*Primary Examiner*—Reinaldo P. Machado
*Attorney, Agent, or Firm*—John C. La Prade

[57] ABSTRACT

A lifting apparatus usable to lift heavy loads from the ground to a roof surface including a horizontally positioned, shoulder mounted lifting bar or beam with a winch means, fastened to the bar or beam where one end of the lifting bar or beam is pivotally connected to a vertically positioned ladder or extension ladder, with means to allow pivotal rotation of the upper end of the ladder toward the roof to deposit the load on the roof or into a window of a multi-story building.

24 Claims, 5 Drawing Sheets

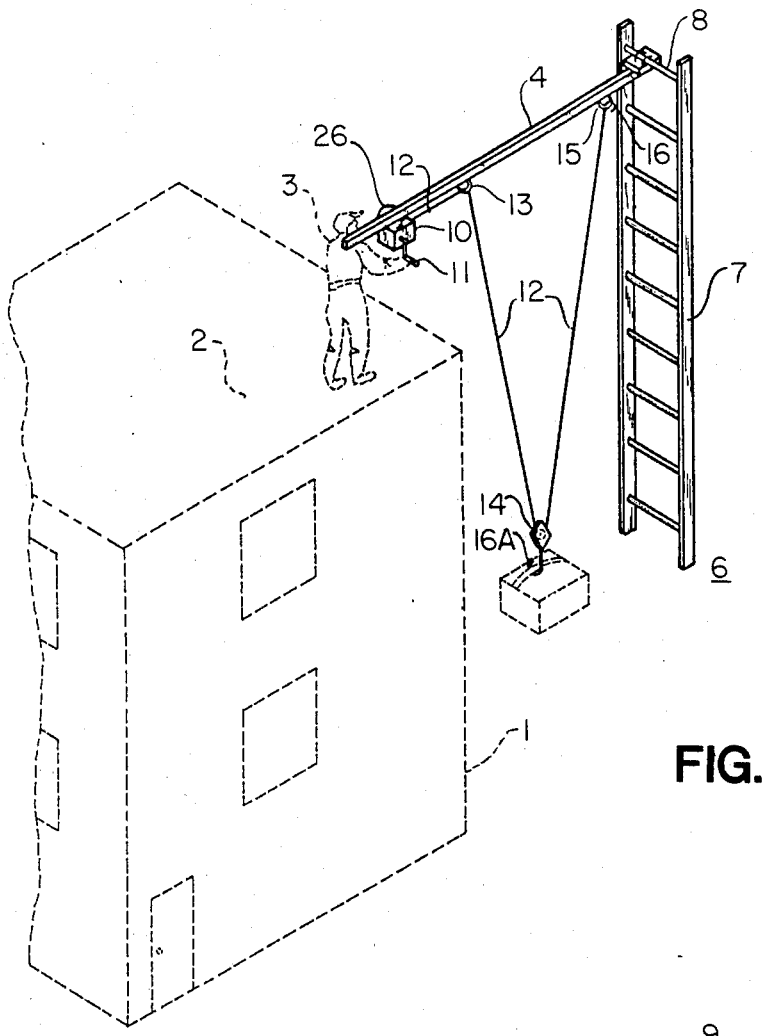
FIG. 1
FIG. 2A
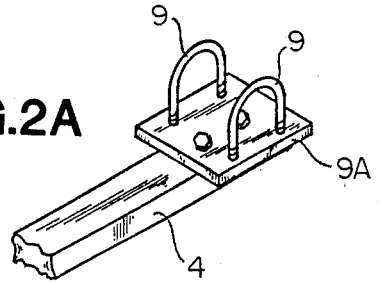
FIG. 1A
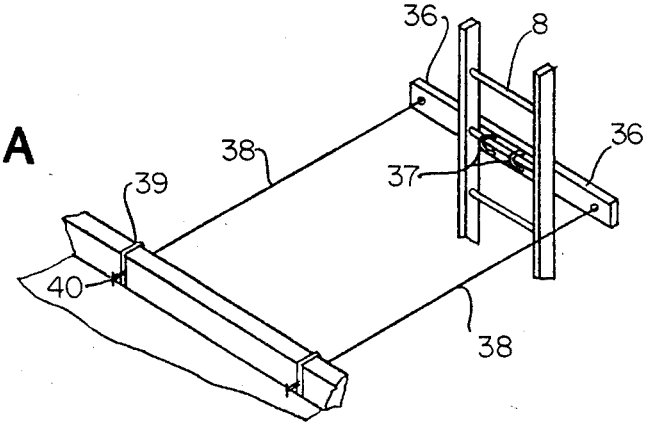

FIG.3
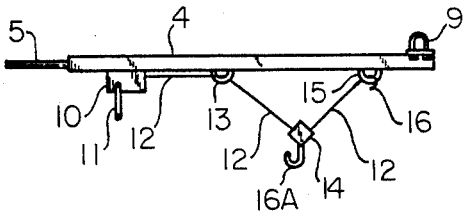
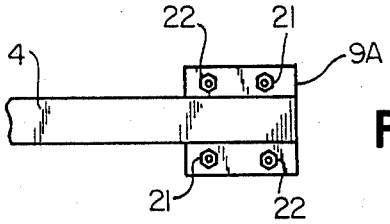
FIG.4
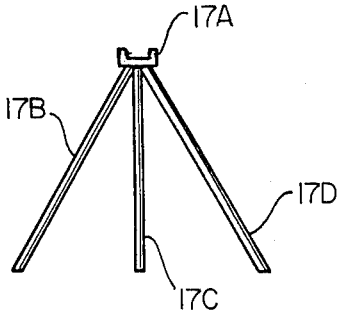
FIG.3B
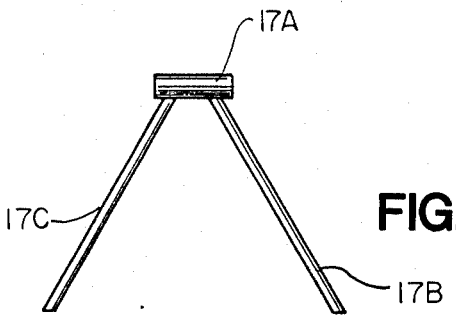
FIG.3A
FIG.5
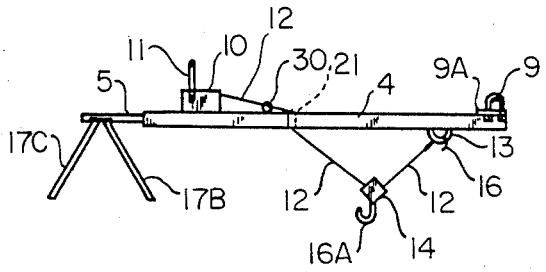

FIG.8
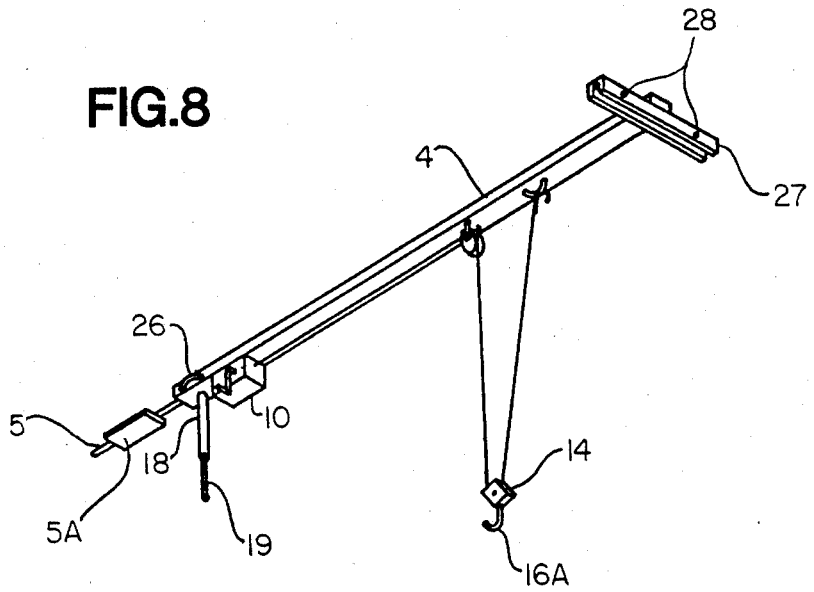
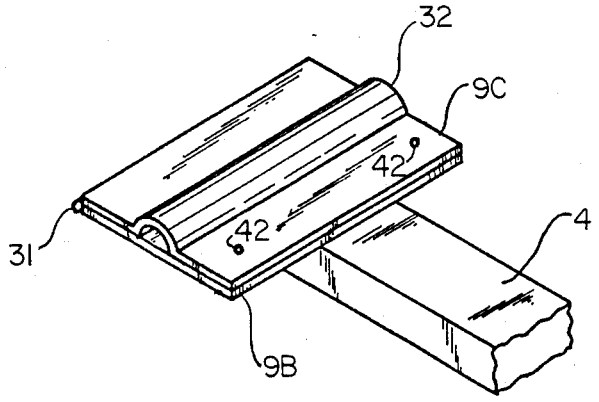
FIG.5A

FIG.6
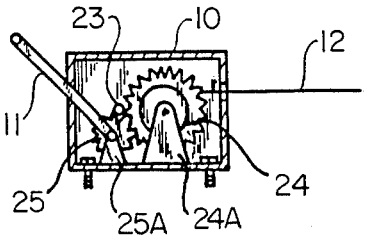
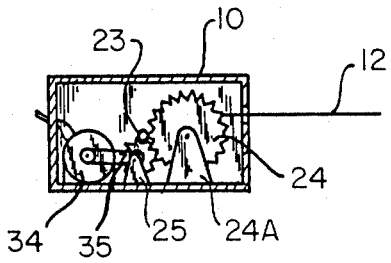
FIG.7
FIG.9
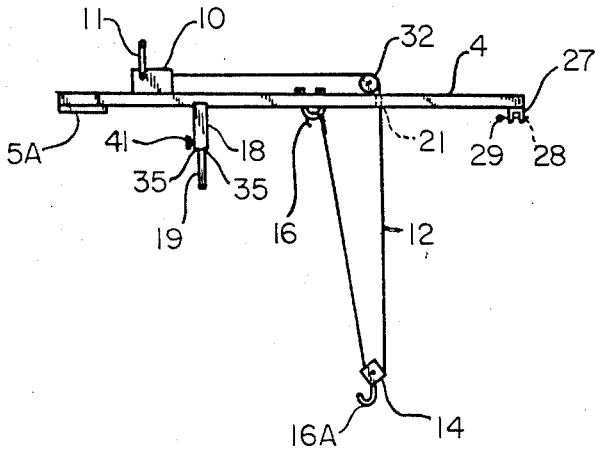

LADDER LIFT APPARATUS

BACKGROUND OF THE INVENTION

The present invention relates to a lifting apparatus and tool for use by air condition contractors, carpenters, electricians, painters, and roofers who need to move materials to the second, third, and fourth stories or roofs of buildings being constructed or remodeled.

Various lift devices, utilizing hand operated winches or windlasses are known in the art. Typically of those found in the art are illustrated in U.S. Pat. Nos. 2,426,825, 4,232,759, and 4,458,764. In particular U.S. Pat. Nos. 599,169; 4,598,795 and 4,690,248 disclose ladder bracket and ladder lifts of various types.

The present invention comprises a one piece, light weight shoulder mounted lifting bar that has means to be pivotally attached to the end of an industrial ladder to allow the operator to move a piece of equipment or a materials container onto the roof of a multistory building that is usually from 2 to 4 stories high or higher.

SUMMARY OF THE INVENTION

Accordingly, it is the primary object of the present invention to provide a lifting apparatus which avoids the disadvantages of the prior art.

It is another object of the present invention to provide a ladder lift apparatus which requires little set up time by one man and is sturdy and inexpensive to manufacture and has a total weight of 20 to 40 pounds.

It is still one additional object of the present invention to provide a lifting apparatus and tool that combines a vertically positioned extension ladder with a horizontally positioned lifting bar equipped with winch and cable means to allow an operator standing on the roof to move a heavy load from the ground onto the roof.

It is one further object of the present invention to provide connection means to attach the apparatus of this invention to one of the upper rungs of a ladder or extension ladder, so that the rung can turn or pivot within the connection means. This allows the load to be pulled onto the edge of the roof after the load is suspended at its maximum vertical position, to allow the load to be deposited on the roof or into an open, upper story window.

It is also one additional object of the invention to provide a horizontally positioned lifting bar apparatus with a padded shoulder mount member that allows one end of the lifting bar to be supported by the shoulder of the operator while standing on the roof or on an upper floor of a building and the other end of the lifting bar is supported by a ladder.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the first embodiment of the invention illustrated in use on top of a building.

FIG. 1A is a partially cut away view of the ladder with stabilizer means attached.

FIG. 2A is a partly cut away view of one connection means for the lift bar to the ladder.

FIG. 3 is a plan view of one embodiment of the invention.

FIG. 3A is a side view of a support tripod for the lift bar of the instant invention.

FIG. 3B is an end view of the support tripod shown in FIG. 3A.

FIG. 4 is a partial view of the ladder connection means of the invention illustrated in FIG. 3.

FIG. 5 is a side view of an alternative embodiment of the invention.

FIG. 5A is a perspective view of one alternative means to connect the lift bar to a ladder rung.

FIG. 6 is a partially cut away, detailed view of the winch or windlass assembly, shown in FIG. 3.

FIG. 7 is a schematic of an alternative embodiment of the winch or windlass assembly shown in FIG. 3.

FIG. 8 is a perspective view of an alternative embodiment of the invention.

FIG. 9 is a side view of an embodiment of the invention where the winch is top mounted on the support bar or beam.

DESCRIPTION OF THE PREFERRED EMBODIMENT

Figure 2:
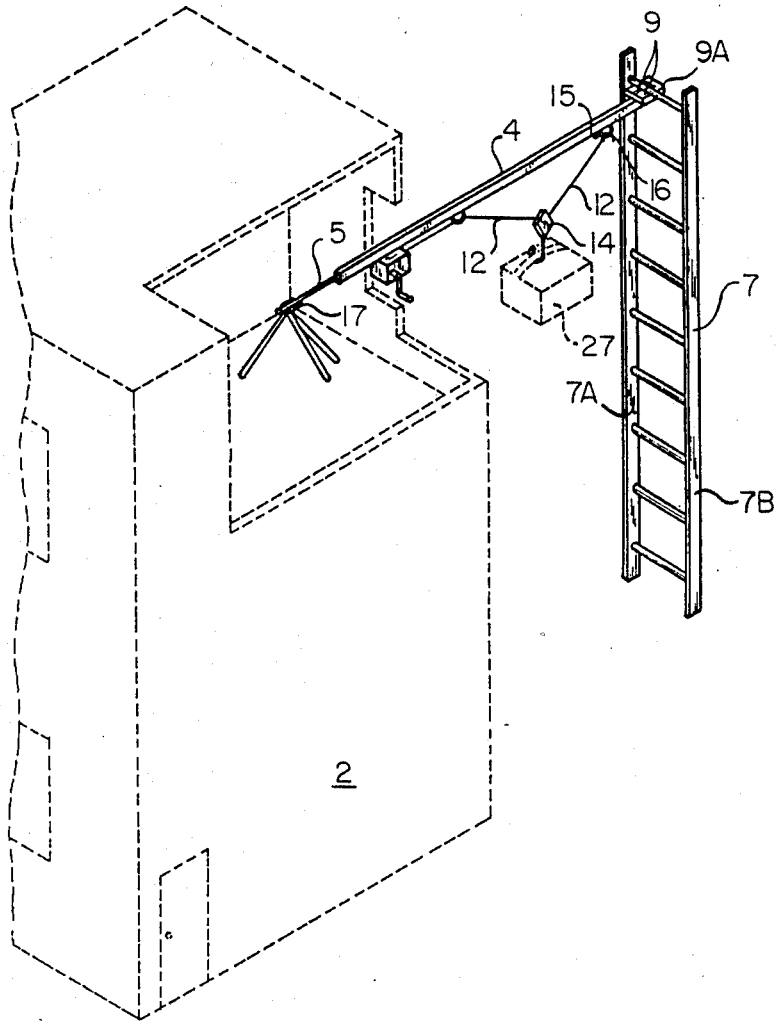
FIG. 2 is a detailed perspective view of one embodiment of the invention illustrated in use in an open window of a building.

In FIG. 1, that is a perspective view, a building 1, with a flat roof 2 supports an operator 3. The operator 3 standing on the roof operates lifting bar 4 by placing one end of the bar with shoulder support 5 on the operator's shoulder. The bar 4 is supported and attached by a connection on its other end to a ladder or equivalent support member that stands on the ground 6. The ladder 7 may be a conventional industrial grade heavy duty ladder. If an extension ladder 7, is used, it should be an industrially rated ladder, marked to indicate its ability to safely support at least 250 lbs. The ladder 7 has rungs 8. The lift bar 4 is attached to and supported by one of the top rungs 8 of the ladder 7 by bolts best shown in FIG. 2A. These bolts fasten the lift bar 4 to a laterally extending plate 9A mounted on one end of the lift bar 4. In FIGS. 2, 3, and in FIG. 4 the lateral plate 9A is connected to one rung of the ladder by means of a pair of inverted U-bolts 9, that slip over one of the ladder rungs 8 to give a pivotal, right angle connection between the lifting bar 4 and the ladder 7 where the rung 8 can freely turn within the U bolts (9).

A conventional winch or windless assembly, 10 may be mounted by bolting or by welding the winch 10 to the upper face or the lower face of lifting bar 4. FIG. 1 shows the winch 10 mounted on the lower face of bar 4.

The winch or windlass assembly 10 in FIG. 3, may consist of a conventional winch or windlass, ratchet and pawl, best shown in FIG. 6 and FIG. 7. Such a winch assembly may have a ratchet gear ratio of about 1 to 4 to 1 to 17 or more to allow the winch to be turned more easily by the operator.

The winch or windlass 10 has a drum on which 30 to 40 ft. or more of cable is stored and is fed out, when in use. Cable 12 may be fed out through a cable guide means 13. The cable 12 may be used with a pulley 14 having a hook 16A on its lower end. In such arrangement, as shown in FIG. 3, the end of cable 12 is fitted with a hook 16 that is secured in cable guide means 15. In this arrangement, the weight of the load is evenly divided between the two guide means 13 and 15. In such a configuration the operator will find it much easier to turn the crank handle 11 of the windlass or winch 10.

The lift bar tool illustrated in FIG. 1 is designed to have one end of the lift bar 4 rest on the operators shoulder in order to speed up the operation of lifting and to make it more efficient. In some cases, where the load is over 300 lbs. and particularly in the range of 400 lbs. to 500 lbs. an alternative support means may be used to support the lift bar 4. The lift bar may be supported by a pivotal post 18 and telescopic leg 19 that may be rotated into position as best shown in FIG. 8A tripod 17A may be used to support one end of bar 4 as shown in FIG. 2.

As shown in FIG. 8, the bar 4 may be equipped with a handle 26 mounted on the side of the lift bar 4 and is usually on the top of or positioned on the side opposite the winch handle 11. The handle 26 as best illustrated in Figure may be used primarily to balance the lift bar 4 which the crank-handle 11 is being turned by the operator.

When the operator is turning crank handle 11 with one hand he may also, simultaneously hold handle 26 with the other hand and thereby have a more secure grip on the lift bar 4 during the lifting operation.

FIG. 8 illustrates an alternative means to adapt lift bar 4 by attachment to rung 8 of ladder 7. In FIG. 8 an open inverted, U-shaped bracket 27, completely open along its lower edges with holes 28 in each lower leg is bolted or otherwise fastened to the lower face of lift bar 4, by bolts, not shown. The lower edges of bracket 27 may be fastened to the top rung 8 or another rung by sliding bracket 27 over the rung 8 and placing two or more cotter pins or bolts through the holes 28. In such arrangement the weight of the lift bar 4 and the weight of the load is evenly distributed along the U-bracket 27 and transferred to the ladder rung 8.

In FIG. 9, the post 18 may be fitted with a lower tubular telescopic leg 19 that fully telescopes to be housed within post 18. Set screw or bolts 41 or other fastening means may be used to adjust and fasten tubular legs 18 and 19 at a proper position so that lift bar 4 is maintained in a horizontal position during lifting and the ladder 7 is maintained in a vertical position and parallel to the side of the building until the load is at its maximum height.

In FIG. 3A tripod 17 is shown as a alternate means of elevating shoulder support 5 and supports the weight of lift bar 4 and the load, particularly where a heavy load in the range of 400 lb. to 500 lbs. is lifted. The shoulder support may be padded.

FIG. 2, illustrates in a perspective view, in greater detail the shoulder support 5 that may be bolted to one end of the lift bar 4 so as to engage the tripod 17.

FIG. 2 also illustrates how lift bar 4 may be pivotally fastened to the ladder 7 in such a manner that when the load is engaged by the cable and windlass assembly the ladder is at a right angle to the ground and parallel to the building 2. It is also apparent that a 90 degree, right angle should be maintained between lift bar 4 and the ladder 7 by a connector means that allows pivotal, sliding contact between the ladder rung and the connectors until the load is at a position to be pivoted onto the roof or into an open window at the work site by pulling the bar 4 or shoulder mount 5 in a horizontal plane toward the operator.

FIG. 2A is a partially cut away view of the lateral plate 9A and a pair of U-bolts used to fasten one end of lift bar 4 to a ladder rung 8. In this embodiment a flat plate 9A, about 12 inches in length, is fastened to the upper surface of bar 4. The flat plate 9A has a pair of holes 21 and 22 (FIG. 4) at each end of the plate. The ends of each U-bolt 9 fit into holes 21 and 22. The distance between the pairs of holes 21 and 22 should be determined so that each U-bolt is located as close as possible to the interior surface of ladder legs 7A and 7B.

FIG. 3 illustrates a plan view of an alternative embodiment of the invention. In this view the shoulder mount member 5 may be supported while lifting loads of 300 to 500 lbs. by a platform that may be a tripod. A rotatable post leg 18 is best shown in FIG. 9.

In FIG. 3A and FIG. 3B the tripod 17 may have an upper housing 17A, that may be rectangular in cross sectional shape to accommodate the end of bar 4. The tripod has legs 17B, 17C, and 17D. FIG. 2 also illustrates the use of a basket 27 with support cable, chain, or rope that may be fastened to pulley and hook 14 to carry roofing materials or lumber.

FIG. 4 is a top view of the lift bar 4 that illustrates lateral support plate 9A. The lateral plate 9A may be 11 to 12 inches long and have a pair of holes 21 and a pair of holes 22 near the ends of the plate to accommodate a pair of U-bolts, used to fasten the lift bar to an extension ladder.

FIG. 5 illustrates another preferred embodiment, where the winch or windlass assembly 10 comprising a drum, ratchet gear, pawl, and crank arm are mounted on top of lift bar 4. When cable 12 is fed off of the drum 24 it proceeds through an opening 21 in the lift bar and the cable feeds through pulley 14 and is hooked to guide means 15 to evenly divide the weight of the load.

In FIG. 5A, another alternative means is illustrated for attaching the ladder 7 to the lift bar 4. In this embodiment the rung 8 is enclosed by a plate 9B and plate 9C. These plates have a hinge 31 along the rearward edge of each plate and the hinged upper plate 9C has a curved surface 32 that is curved to fit over a ladder rung 8, not shown. The plate 9B may be fastened to plate 9C by a pair of stud bolts or pins, not shown, that may project from plate 9B and in a closed position project through corresponding holes 42. The stud bolts may be secured over plate 32 by nuts or wing nuts, not shown.

FIG. 6 illustrates in detail the windlass assembly, pawl 23 including the drum 24 and drum support pivot member 24A, ratchet 25, and ratchet support pivot member 25A and crank arm 11.

FIG. 7 illustrates in partly cut away view of an electrically driven winch 10 with drum 24, electric motor 34, drive train for the motor 35 and switch.

In FIG. 8, as described above, the lift bar 4 has a side handle 26 that maybe mounted at a point approximately opposite crank handle 11, and an auxiliary support means comprising a rotatable post 18 that has a telescopic leg 19 that can be used to adjust the height of the lift bar 4 to keep the lift bar 4 level during the operation of the winch 10 and until the load is lifted to the level of the roof.

FIG. 9 is side view of lift bar 4 with the winch 10 mounted on top of the bar 4. The cable 12 is fed out over the pulley 32. The cable is fed through an opening 21 that runs through bar 4 from top to bottom. This figure also illustrates the inverted U-bracket 27 used to adapt and fasten the lift bar 4 onto one rung 8 of the ladder so that the rung 8 can rotate within the bracket 27. The bracket 27 may be fastened to the rung by a pair of cotter pins 29 that fit into opposed pairs of holes 28 in the lower legs of the inverted U-shaped bracket 27. This figure also shows that lift bar 4, on the opposite end, can be extended for 10 to 20 inches beyond the winch assembly 10 and have its lower surface 5A padded to form a comfortable shoulder rest for the operator.

The lift bar 4 is usually made of a mild steel or a mild steel-aluminum alloy having a preferred weight in the range of 2 pounds to 6 pounds per linear foot. While a rectangular cross section 4 inches wide by two inches high for lift bar 4 is preferred, other configurations may be used i.e., 2 inches by 3 inches and aluminum I-beams 2 to 4 inches high and having 2 to 4 inches wide may also be used as the bar member 4.

The weight of the lift bar 4 should be carefully controlled to allow the total weight of the lift bar and winch assembly to be in the weight range of 20 lb. to 40 lbs. and still withstand a bending moments of 500 lbs. at the center of the lift bar.

In addition, it should be pointed out that with the load limited to a maximum of 500 lbs., 250 lbs. will be supported by the operator or an auxiliary support, i.e. tripod, and 250 lbs. will be supported by the ladder 7. Therefore a 250 lb. approved ladder will support one half (½) of a 500 lb. load.

A stabilizer means 36 shown in FIG. 1, may be used to completely assure the safe delivery of the load and the stable vertical position of the ladder 7 during the lifting operation.

The stabilizer means that is best illustrated in FIG. 1A comprises a bar or brace 36 to retain the ladder 7 in a position that is parallel to the building and prevents the top of the ladder from moving until the load is at its maximum height during the lifting operation. The stabilizer bar 36, preferably made of a tubular of flat metallic material that is fastened to the upper end of the ladder by clips fasteners or hooks 37 that fasten the bar 36 to each of the two ladder legs 7A and 7B at or near the top rung. Each end of the brace 37 may be fastened to a cable or rope 38. The other ends of the cables or ropes may be attached to a pair of clamps 39 that may be slidably engaged over a parapet wall or clamped to other solid objects on the roof by screws 40. For example, the clamps 39 may engage the top, front and rear edges of a parapet wall around the edge of the roof of the building to stabilize the ladder. The clamps 39 may be released from the parapet wall by releasing screws 40 or from the top of the parapet wall by the operators by hand or otherwise to allow the upper end of the ladder to move to the building to allow delivery of the load onto the roof. The stabilizer brace or bar 36 may be in one or two parts with each end extending from about 8 inches to 16 inches beyond the ladder legs so that the load may pass between the two cables or ropes 38 that attach to clamps 39.

The attachment of the stabilizer brace or bar 36 is optional and is used to insure that the ladder remains completely parallel to the building while the load is engaged and lifted.

A cable or rope may likewise be used to secure the bottom of the ladder to the building to prevent the ladders movement while the load is deposited on the roof.

METHOD OF OPERATION

In the method of operating the lift bar of the instant invention the following steps should be followed, in sequence:

(1) The ladder 7, (one piece ladder or extension ladder) should be extended up beside the building so that one or more of the top rungs are above the lowest roof level.

(2) The operator takes the lift bar on his shoulder and climbs to the top of the building and places the lift bar 4 on the roof.

(3) Bolt or clamp the lift bar 4 to one rung of the ladder so as to allow rotational or pivotal movement between the rung and the attachment means positioned on one end of the lift bar.

(4) While holding the shoulder-mount end of the lift bar the operator pushes the top of the ladder out from the building until the ladder is parallel to the building. The ladder should never be set up more than 46 to 48 inches from the building. Optionally a stabilizer means may be attached to the ladder to secure it in a vertical, parallel position, as set forth above.

(5) Optionally attach a flange and safety rope or cable to secure the bottom of the ladder to the building so that the ladder will not kick out during transfer of the load to the building.

(6) The operator then places shoulder mount 5 on his shoulder.

(7) The load is attached to the lower end of the cable and the operator starts the winch to place tension on the cable.

(8) The operation of the winch lifts the load to the general level of the top rung of the ladder.

(9) When the load is in a proper position the operator moves back and pulls shoulder mount 5 away from the edge of the roof so that the load will pivotly move onto the roof. The ladder pivots at the ground level and the top of the ladder moves to the edge of the roof.

(10) The load is then deposited on the roof or into an open window in the same manner.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

We claim:

1. A lift apparatus for use to lift a heavy load from the ground to the roof of a building comprising in combination:

(a) a vertically positioned heavy duty ladder with multiple rungs, (b) a horizontally positioned lift bar member, with lifting means attached to the lift bar member, (c) attachment means positioned on one end of the lift bar to pivotally attach one ladder rung to the lift bar so that the rung can rotate within the attachment means and as the lift bar is moved and means to support the opposite end of the lift bar on the operators shoulder, (d) means to pivot the upper end of the ladder to the edge of the roof to allow delivery of the load onto the roof.

2. The lift apparatus of claim 1, where in the ladder is an extension ladder.

3. The lifting apparatus defined in claim 1, wherein the horizontal lift bar member is a straight, light weight tubular member of sufficient strength to avoid bending under a load of 500 lb.

4. The lift apparatus as defined in claim 1 where the means to pivotally attach the lift bar to the ladder is a pair of bolts.

5. claim 4 where one end of the lift bar is bolted to a ladder rung.

6. The lift apparatus defined in claim 1. Wherein, the means to attach the lift bar member to a ladder rung is a U-shaped bracket that snaps over one ladder rung in such a manner as to allow the rung to turn within the U-shaped bracket as the lift bar is moved with respect to the ladder.

7. The lift apparatus of claim 1 wherein the means to lift the load is a winch assembly, comprising a drum, ratchet gear, pawl and crank handle that operates the ratchet gear, cable, pulley, and hook.

8. The lift apparatus defined in claim 6, where the U-shaped bracket is bolted around one rung of the ladder.

9. The lift apparatus defined in claim 2 wherein the means to pivot the upper end of the ladder is a handle member extending from the side of the lift bar.

10. The lift apparatus as defined in claim 1 where the operator shoulder support means is supplemented by a mobile platform member.

11. The lift apparatus as defined in claim 10 where the platform member is a tripod.

12. In a ladder lift system including vertical structure comprising a conventional extension ladder mounted in a vertical position adjacent to and generally parallel to the side wall of a building and horizontal structure attached to the vertical positioned ladder; the improvement comprising as a part of the horizontal structure, a horizontally positioned lift bar, means to pivotally fasten one end of the lift bar to one rung of the vertically extended ladder, and where one surface of the lift bar is fitted with a lift means including a cable and at least one cable guide means and when the lift means is manually operated by an operator who supports one end of the lift bar.

13. The ladder lift system defined in claim 12 where the winch lift means comprises a winch, associated cable and at least one cable guide means.

14. The ladder lift system defined in claim 12, where the means to fasten one end of lift bar to the ladder is a laterally disposed bracket member permanently fastened to the lift bar and where the bracket member is fitted with means to fasten the lift bar to one of the ladder rungs.

15. The ladder lift system defined in claim 13 where the lift means is an electrically driven winch that the operator initiates while supporting one end of the lift bar.

16. The ladder lift system defined in claim 12 where the winch is hand operated by an operator who turns the crank arm while supporting one end of the lift bar.

17. The ladder lift system defined in claim 12 where a clamp means fastens the lift bar to one of the rungs of the ladder while the clamp allows rotational movement between the lift bar and the ladder rung.

18. The ladder lift system defined in claim 17 where the clamp is a two piece clamp having a hinge along one edge and bolts along the opposite edge.

19. The ladder lift system defined in claim 14 where the bracket is a U-shaped bracket that fits over a ladder rung.

20. The ladder lift system defined in claim 19 where the U-shaped bracket is bolted around one ladder rung.

21. The ladder lift system defined in claim 14 where the means to fasten the bracket to the ladder rung is a pair of U-bolts.

22. The ladder lift system defined in claim 13 where the winch is mounted on top of the lift bar, an opening is provided through the lift bar to allow the cable to pass through the lift bar and pulley means positioned between the winch means and the opening in the lift bar.

23. The ladder lift system defined in claim 12 where the cable, cable guide means, and means to fasten the lift bar to one rung of the ladder are all located and positioned in one single horizontal plane.

24. The ladder lift system of claim 12 wherein a stabilizer is used to secure the ladder in a vertical position, essentially parallel to the building.

* * * * *